United States Patent [19]

O'Roark

[11] 4,100,097

[45] Jul. 11, 1978

[54] LOW pH DETERGENT BAR

[75] Inventor: James R. O'Roark, Dayton, Ohio

[73] Assignee: The Hewitt Soap Company, Inc., Dayton, Ohio

[21] Appl. No.: 764,875

[22] Filed: Feb. 2, 1977

[51] Int. Cl.[2] ..... C11D 1/28; C11D 3/22; C11D 17/00

[52] U.S. Cl. ..... 252/145; 252/174; 252/557; 252/DIG. 16

[58] Field of Search ..... 252/145, 142, 557, 174, 252/144, DIG. 5, DIG. 16, 130, 132

[56] References Cited

U.S. PATENT DOCUMENTS

| | | | |
|---|---|---|---|
| 2,587,637 | 3/1952 | McDonald | 252/130 |
| 2,653,913 | 9/1953 | Van Dijck et al. | 252/DIG. 16 X |
| 2,734,870 | 2/1956 | Lewis | 252/DIG. 16 X |
| 2,868,731 | 1/1959 | Henderson et al. | 252/117 |
| 2,894,912 | 7/1959 | Geitz | 252/121 |
| 2,982,735 | 5/1961 | Blinka et al. | 252/132 X |
| 3,129,187 | 4/1964 | Meehan | 252/DIG. 16 X |
| 3,248,333 | 4/1966 | O'Roark | 252/144 |
| 3,291,744 | 12/1966 | Bohrer | 252/DIG. 16 X |
| 3,442,812 | 5/1969 | Barnhurst et al. | 252/DIG. 16 X |
| 3,798,181 | 3/1974 | Vazquez | 252/DIG. 16 X |

*Primary Examiner*—Harris A. Pitlick

[57] ABSTRACT

A milled synthetic detergent bar providing an acid to neutral pH and having the appearance, feel, handwashing and processing characteristics of soap, consists essentially of coconut-oil fatty acid ester of sodium isethionate and/or sodium lauryl sulfoacetate, paraffin, powdered starch, dextrin, coconut-oil fatty acid and water.

11 Claims, No Drawings

LOW pH DETERGENT BAR

BACKGROUND OF THE INVENTION

This invention relates to detergent compositions in the form of bars. More particularly, this invention relates to milled substantially soap-free detergent bars providing an acid to neutral pH.

A detergent bar having an acid pH has been deemed desirable since normal skin has a pH in the acid range (approximately 5.7). It has been postulated that if satisfactory cleansing action can be obtained without disturbing the acid mantle of the skin, an acceptable detergent bar providing such action would be especially useful to people with exceptionally sensitive skins as well as to normally healthy individuals. Since normal alkali metal soap has a pH in the range from about 10.4 to 10.6, it is not possible to provide a bar which depends primarily on soap for its cleansing action and which also provides an acid or neutral pH. With the advent of synthetic detergents, an acid bar became a practical reality.

My U.S. Pat. No. 3,248,333 is directed to a very satisfactory low pH synthetic detergent bar. However, it has an appearance different from that of soap.

It is an object of this invention to provide a milled synthetic detergent bar which has an acid to neutral pH and which has an appearance more closely resembling that of a milled soap bar.

It is a further object of this invention to provide a low pH synthetic detergent bar which has the feel and handwashing (lather) characteristics of a soap bar, which is highly acceptable for washing human skin and which is produced utilizing conventional soap equipment.

These and other objects and advantages are achieved by the invention herein which is described below.

BRIEF DESCRIPTION OF THE INVENTION

The low pH bar of this invention is a milled synthetic detergent bar providing a pH of from about 4 to about 7 at a use concentration of about 1% by weight in water which consists essentially of (a) from about 20% to about 40% by weight of a synthetic detergent selected from the group consisting of coconut-oil fatty acid ester of sodium isethionate and sodium lauryl sulfoacetate; (b) from about 10% to about 30% by weight of paraffin; (c) from about 5% to about 15% by weight powdered starch; (d) from about 10% to about 30% dextrin; (e) from about 1.5% to about 5% by weight coconut-oil fatty acid; and (f) from about 8% to about 15% by weight water.

DETAILED DESCRIPTION OF THE INVENTION

We turn first of all to the detergent ingredients. The isethionate has its ester groups consisting of fatty acids derived from coconut-oil. It is readily available commercially. It can be obtained, for example, from General Aniline & Film Corporation under the tradename Igepon AC-78 (according to the manufacturer's specifications, this contains a minimum active content of 83% by weight with the remainder consisting mainly of moisture, salts, free fatty matter and soap). The sodium lauryl sulfoacetate is also readily available commercially. It can be obtained, for example, from Stepan Chemical Company under the tradename Lathanol LAL (according to the manufacturer's specifications, this contains about 70% active with the remainder consisting mainly of salts and minor amounts of volatile matter). When the coconut-oil fatty ester of sodium isethionate is used alone (rather than in conjunction with the sulfoacetate), it preferably is present in an amount ranging from about 25% to about 37.5% by weight. When the sodium lauryl sulfoacetate is used alone (rather than in conjunction with isethionate), it preferably is present in an amount ranging from about 22.5% to about 37.5% by weight. Very preferably, the isethionate and sulfoacetate are used together with the isethionate being present in an amount ranging from about 10% to about 25% by weight and the sulfoacetate being present in an amount ranging from about 10% to about 20% by weight, with the total of the isethionate and sulfoacetate being present in an amount ranging from about 20% to about 40% by weight. The isethionate appears to provide somewhat quicker lather while the sulfoacetate appears to provide a more stable sudsing character; the aforedescribed use of the two in combination provides the best overall performance.

The paraffin ingredient is preferably a fully refined petroleum wax having a melting point ranging from about 130° F. to about 140° F. This wax is odorless and tasteless and meets FDA requirements for use as coatings for food and food packages. Such paraffins are readily available commercially. A very suitable paraffin can be obtained, for example, from The Standard Oil Company of Ohio under the tradename Factowax R-133. The paraffin preferably is present in the bar in an amount ranging from about 15% to about 25% by weight. The paraffin ingredient is used in the product to impart plasticity, firmness, and processability over soap equipment. It also provides a glossy look and smooth feel to the bar.

The paraffin ingredient is optionally supplemented by a microcrystalline wax. A suitable microcrystalline wax has a melting point ranging, for example, from about 140° F. to about 160° F., preferably from about 145° F. to about 155° F. The wax preferably should meet the FDA requirements for food grade microcrystalline waxes. A very suitable microcrystalline wax is obtained from Witco Chemical Company under the tradename Multiwax X-145A. The microcrystalline wax preferably is present in the bar in an amount ranging from about 0.5% to about 5% by weight. The microcrystalline wax ingredient imparts pliability to the bar at room temperatures.

The combination of powdered starch and dextrin ingredients provide a unique filler system to help provide, with the waxes, a base to carry the detergent.

The powdered starch ingredient is preferably selected from the group consisting of pregelatinized starch and non-gelling starch, and very preferably the total starch ingredient used is present in the bar in an amount ranging from about 7.5% to about 13.5% by weight. The pregelantinized starch is preferably a gelling pregelatinized starch such as precooked corn starch which has been dried and powdered. A very suitable gelling pregelatinized starch is obtained from CPC International under the tradename Amidex (B-511). The gelling pregelatinized starch is very tacky, providing binding and imparting slip feel to the bar. This starch works particularly well when coconut-oil fatty acid ester of sodium isethionate is used as a detergent ingredient. The non-gelling starch is preferably a 100% amylopectin starch. A very suitable 100% amylopectin starch is obtained from National Starch under the tradename Amioca. The 100% amylopectin starch imparts very desirable processing characteristics to the formula. This starch works particularly well when sodium lauryl sulfoacetate is used as a detergent ingredient. The two types of starches can be used in conjunction with each other in a total amount within the aforedescribed broad range to help provide optimum slip-feel and processability. A bar including both types of starches can include, for example, from about 5% to about 10% by weight gelling pregelatinized starch and from about 2% to about 4% by weight non-gelling 100% amylopectin starch.

The dextrin ingredient is dextrin having a water solubility ranging from about 25% to about 85% (about 25% to about 85% by weight of the dextrin dissolves in water, and the rest is insoluble). Very preferably, the total amount of dextrin used is present in the bar in an amount ranging from about 12.5% to about 25% by weight. Very preferably, the dextrin ingredient is selected from the group consisting of dextrin having a water solubility ranging from about 25% to about 55%, and dextrin having a water solubility ranging from about 60% to about 85%. Dextrin having a water solubility ranging from about 25% to about 55%, with its higher insoluble content, can be used to control washing wear rate and to improve processability. A dextrin of this type is obtained from National Starch and Chemical Corporation under the tradename Nadex 341 (it is a white powdered corn dextrin and has an average water solubility of about 40%). Dextrin having a water solubility ranging from about 60% to about 85% imparts a smooth slip-feel to the bar but introduces higher washing wear rate and tends to lower processability. A dextrin of this type is obtained from National Starch and Chemical Corporation under the tradename Nadex 419 (it is a white powdered corn dextrin and has an average water solubility of about 70%). By using these two types of dextrins in conjunction (both types together being used in a total amount within the aforedescribed broad range), optimum conditions can be achieved for bar feel, washing wear rate and processability. Very preferably, the two types of dextrins are used in conjunction with each other in the same bar, and dextrin having a water solubility ranging from about 25% to about 55% is present in the bar in an amount ranging from about 2% to about 20% by weight and dextrin having a water solubility ranging from about 60% to about 85% is present in the bar in an amount ranging from about 5% to about 20% by weight with the total of the two types of dextrin being present in the bar in an amount ranging from about 12.5% to about 25% by weight. The dextrin water solubilities herein are in 72° F. water.

The coconut-oil fatty acid is preferably double distilled coconut-oil fatty acid having an Iodine Value ranging from about 6 to about 14. A suitable coconut-oil fatty acid consists by weight, for example, of 15% capric and caprylic acids, 48% lauric acid, 18% myristic acid, 9% palmitic acid, 2% stearic acid, 6% oleic acid and 2% linoleic acid. Preferably, the coconut-oil fatty acid is present in a bar in an amount ranging from about 1.5% to about 2.5% by weight. The coconut-oil fatty acid improves the plasticity of the paraffin in the bar and improves the sudsing performance (increases the lather and makes it creamier) of the bar. Lauric diethanolamide can optionally be included in a bar; it is used at a level ranging from about 0.5% to about 5% by weight to supplement the coconut-oil fatty acid to improve suds stability.

The water content is required to effect necessary processability over soap line equipment. It also serves as a binder and plasticizer. Water content varies with the starch-dextrin combination used. Preferably, water is present in an amount ranging from about 9.0% to about 14.5% by weight.

Sodium chloride is optionally included. It is used for example, at a level ranging from about 0.5% to about 4% by weight, for processing purposes. It is, for example, of positive assistance in making a premix of water and powdered starch(es) before crutcher mixing (see processing described below).

The pH of the bar normally falls in a 5.0–7.0 range, governed primarily by the acid dextrins. Lactic acid, citric acid or other similar organic acid is readily utilized to adjust pH downward. Lactic acid is very desirably included, for example at a level ranging from about 0.4% to about 0.6% by weight. Sodium bicarbonate, sodium carbonate, magnesium oxide or other suitable alkaline salt is readily utilized to adjust the pH upward.

While bars produced according to this invention have demonstrated no deterioration due to bacterial activity, it is recognized that dextrin content particularly can support bacterial growth. To obviate this possibility, antimicrobials, e.g. methyl and propyl parabens can optionally be included, for example, at a level ranging from about 0.25% to about 1% by weight.

Added bar slip-feel is readily obtained by incorporation of such agents as high molecular weight polymers of ethylene oxide (e.g. a polymer sold under the tradename Polyox WSR 205 by Union Carbide) and high molecular weight polymers of acrylamide (e.g. a polymer sold under the tradename Gelamide F by American Cyanamid).

The most preferred bar within the scope of the invention is a detergent bar consisting essentially of (a) from about 10% to about 25% by weight coconut-oil fatty acid ester of sodium isethionate and from about 10% to about 20% by weight sodium lauryl sulfoacetate, the total of the isethionate and sulfoacetate being present in an amount ranging from about 20% to about 40% by weight; (b) from about 15% to about 25% by weight paraffin; (c) from about 0.5% to about 1.5% by weight microcrystalline wax; (d) from about 5% to about 10% by weight non-gelling 100% amylopectin starch; (e) from about 1.5% to about 2.5% by weight coconut-oil fatty acid; (f) from about 1.5% to about 2.5% lauric diethanolamide; (g) from about 5% to about 10% by weight dextrin having a water solubility ranging from about 55% to about 85%; (h) from about 10% to about 20% by weight dextrin having a water solubility ranging from about 25% to about 55%; and (i) from about 9.0% to about 12.5% by weight water.

The ingredients can be processed to form bars using conventional soap line equipment. For example, processing can be carried out as follows: First, premelted waxes (microcrystalline wax, if any is used, and paraffin) are added to the crutcher. Next, lauric diethanolamide (if any is included in the formula) is added into the crutcher in premelted form. The temperature in the mix is then adjusted to be in the 190° F–200° F. range. Next, the liquid coconut-oil fatty acid is added; and then the powdered detergent; this lowers the temperature of the mix. Then crutcher agitation is started and heat is supplied. This is continued until a smooth slurry is obtained at 160° F.–180° F. Next, the dextrins are introduced. Then crutcher agitation is started again, and heating is supplied; this is continued until a uniform slurry is obtained at 160° F.–180° F. Then, a pre-mixed powdered starch-water slurry is added, and again crutcher agitation is continued and heat is supplied until the total contents are uniform at 160° F.–180° F. Lactic or other acid (to modify bar pH) is readily added with the starch-water slurry. The resulting mix is dropped on a cold roll and taken off in the form of a chip or flake. These (chips or flakes) are passed through a plodder. The effluent from the plodder is collected in soap buggies. The buggies feed the conventional soap equipment line consisting of an amalgamator, mills, vacuum plodder and soap press.

The following examples illustrate, but do not limit the practice of the invention.

EXAMPLE I

Detergent bars within the scope of the invention were made up (utilizing processing as particularly described above) having the following composition:

| Ingredient | Weight Percent |
|---|---|
| Igepon AC-78 | 35.0 |
| Paraffin (m.p. 133° F.) - Factowax R-133 | 20.0 |
| Powdered Pregelatinized Starch - Amidex (B-511) | 13.0 |
| Coconut-Oil Fatty Acid | 2.0 |
| Sodium Chloride | 2.0 |
| Dextrin - Nadex 419 | 15.0 |
| Lactic Acid (88%) | 0.5 |
| Water | 12.5 |
| | 100.0 |

The bars were found to have the following characteristics:

| | |
|---|---|
| pH | 5.5±1.0 |
| Soft water lather (85° F.) | Excellent |
| Hard water lather (85° F.) | Good |
| Lather stability | Fair |
| Bar slip-feel | Good |
| Surface striation | None |
| Surface cracking | None |
| Solubility rate | Low |
| Resistance to smear | Good |
| Bar appearance (similarity to soap) | Excellent |
| Processability | Good |

EXAMPLE II

Detergent bars within the scope of the invention were made up (utilizing processing as particularly described above) having the following composition:

| Ingredient | Weight Percent |
|---|---|
| Igepon AC-78 | 37.0 |
| Paraffin (m.p. 133° F.) - Factowax R-133 | 16.0 |
| Microcrystalline Wax - Multiwax X-145A | 4.0 |
| Powdered Non-Gelling 100% Amylopectin Starch-Amioca | 12.0 |
| Coconut-Oil Fatty Acid | 2.0 |
| Lauric Diethanolamide | 2.0 |
| Dextrin - Nadex 419 | 13.0 |
| Water | 14.0 |
| | 100.0 |

The bars were found to have the following characteristics:

| | |
|---|---|
| pH | 6.0±1.0 |
| Soft water lather (85° F.) | Excellent |
| Hard water lather (85° F.) | Good |
| Lather stability | Fair |
| Bar slip-feel | Good |
| Surface striation | None |
| Surface cracking | None |
| Solubility rate | Low |
| Resistance to smear | Good |
| Bar appearance (similarity to soap) | Excellent |
| Processability | Good |

EXAMPLE III

Detergent bars within the scope of the invention were made up (utilizing processing as particularly described above) having the following composition:

| Ingredient | Weight Percent |
|---|---|
| Igepon AC-78 | 37.0 |
| Paraffin (m.p. 133° F.) - Factowax R-133 | 19.0 |
| Microcrystalline wax - Multiwax X-145A | 1.0 |
| Powdered Non-Gelling 100% Amylopectin Starch - Amioca | 3.0 |
| Powdered Pregelatinized Starch - Amidex (B-511) | 8.0 |
| Coconut-Oil Fatty Acid | 2.0 |
| Lauric Diethanolamide | 2.0 |
| Sodium Chloride | 1.0 |
| Dextrin - Nadex 419 | 12.0 |
| Dextrin - Nadex 341 | 4.0 |
| Water | 11.0 |
| | 100.0 |

The bars were found to have the following characteristics:

| | |
|---|---|
| pH | 6.0±1.0 |
| Soft water lather (85° F.) | Excellent |
| Hard water lather (85° F.) | Good |
| Lather stability | Fair |
| Bar slip-feel | Good |
| Surface striation | None |
| Surface cracking | None |
| Solubility rate | Low |
| Resistance to smear | Good |
| Bar Appearance (similarity to soap) | Excellent |
| Processability | Good |

EXAMPLE IV

Detergent bars within the scope of the invention are made up (utilizing processing as particularly described above) having the following composition:

| Ingredient | Weight Percent |
|---|---|
| Lathanol LAL | 35.0 |
| Paraffin (m.p. 133° F.) - Factowax R-133 | 18.0 |
| Microcrystalline Wax - Multiwax X-145A | 2.0 |
| Powdered Non-Gelling 100% Amylopectin Starch-Amioca | 10.0 |
| Coconut-Oil Fatty Acid | 2.0 |
| Lauric Diethanolamide | 1.0 |
| Dextrin - Nadex 419 | 10.0 |
| Dextrin - Nadex 341 | 10.0 |
| Water | 12.0 |

The bars are found to have the following characteristics:

| | |
|---|---|
| pH | 6.0±1.0 |
| Soft water lather (85° F.) | Excellent |
| Hard water lather (85° F.) | Excellent |
| Lather Stability | Excellent |
| Bar slip-feel | Good |
| Surface striation | None |
| Surface cracking | None |
| Solubility rate | Low |
| Resistance to smear | Good |
| Bar appearance (similarity to soap) | Excellent |

-continued

| | |
|---|---|
| Processability | Fair |

EXAMPLE V

Detergent bars within the scope of the invention were made up (utilizing processing as particularly described above) having the following composition:

| Ingredient | Weight Percent |
|---|---|
| Igepon AC-78 | 20.0 |
| Lathanol LAL | 16.0 |
| Paraffin (m.p. 133° F.) - Factowax R-133 | 19.0 |
| Microcrystalline wax - Multiwax X-145A | 1.0 |
| Powdered Non-Gelling 100% Amylopectin Starch - Amioca | 8.0 |
| Coconut-oil Fatty Acid | 2.0 |
| Lauric Diethanolamide | 2.0 |
| Dextrin - Nadex 419 | 7.0 |
| Dextrin - Nadex 341 | 15.0 |
| Water | 10.0 |
| | 100.0 |

The bars were found to have the following characteristics:

| | |
|---|---|
| pH | 6.0±1.0 |
| Soft water Lather (85° F.) | Excellent |
| Hard water Lather (85° F.) | Excellent |
| Lather stability | Good |
| Bar slip-feel | Fair |
| Surface striation | None |
| Surface cracking | None |
| Solubility rate | Low |
| Resistance to smear | Good |
| Bar appearance (similarity to soap) | Excellent |
| Processability | Excellent |

The bars of the above Examples I, II, III, IV and V are highly acceptable for washing human skin.

The invention may be embodied in other specific forms without departing from the essential characteristics thereof. In view of the variations that are readily understood to come within the limits of the invention, such limits are determined by the scope of the claims.

What is claimed is:

1. A milled synthetic detergent bar providing a pH of from about 4 to about 7 at a use concentration of about 1% by weight in water and consisting essentially of (a) from about 20% to about 40% by weight of a synthetic detergent selected from the group consisting of coconut-oil fatty acid ester of sodium isethionate and sodium lauryl sulfoacetate and mixtures thereof; (b) from about 15% to about 25% by weight of paraffin; (c) from about 7.5% to about 13.5% by weight powdered starch; (d) from about 12.5% to about 25% by weight dextrin; (e) coconut-oil fatty acid in an amount up to about 2.5% by weight to improve plasticity of the paraffin and to improve sudsing performance; (f) from about 9.0% to about 14.5% by weight water; (g) from about 0.5% to about 5% microcrystalline wax; (h) from about 0.5% to about 5% by weight lauric diethanolamide; and (i) lactic acid to adjust the pH.

2. A bar as recited in claim 1, in which the synthetic detergent ingredient is coconut-oil fatty acid ester of sodium isethionate and in which the powdered starch consists of both gelling pregelatinized starch and non-gelling 100% amylopectin starch.

3. A bar as recited in claim 2, in which the paraffin ingredient is a fully refined petroleum wax having a melting point ranging from about 130° F. to about 140° F; in which the dextrin ingredient consists of both dextrin having a water solubility ranging from about 25% to about 55% (in 72° F. water) and dextrin having a water solubility ranging from about 60% to 85% (in 72° F. water) and in which the dextrin having a water solubility ranging from 25% to about 55% is present in an amount ranging from about 2% to about 20% by weight and the dextrin having a water solubility ranging from about 60% to about 85% is present in an amount ranging from about 5% to about 20% by weight, in which the microcrystalline wax has a melting point ranging from about 140° F. to about 160° F.; in which sodium chloride is present as an additional ingredient at a level of from about 0.5% to about 4% by weight; and in which lactic acid is used to adjust the pH to range from 5.0 to 7.0.

4. A bar as recited in claim 3, in which the coconut-oil fatty acid is present in an amount ranging from about 1.5% to about 2.5%.

5. A bar as recited in claim 1, in which the synthetic detergent ingredient is sodium lauryl sulfoacetate and in which the powdered starch is non-gelling 100% amylopectin starch.

6. A bar as recited in claim 5, in which the paraffin ingredient is a fully refined petroleum wax having a melting point ranging from about 130° F. to about 140° F.; in which the microcrystalline wax has a melting point ranging from about 140° F. to about 160° F.; and in which lactic acid is used to adjust the pH to range from 5.0 to 7.0.

7. A bar as recited in claim 6, in which the coconut-oil fatty acid is present in an amount ranging from about 1.5% to about 2.5%.

8. A bar as recited in claim 1, in which the synthetic detergent ingredient consists of both sodium lauryl sulfoacetate and coconut-oil fatty acid ester of sodium isethionate, and in which the isethionate is present in an amount ranging from about 10% to about 25% by weight and the sulfoacetate is present in an amount from about 10% to about 20% by weight.

9. A bar as recited in claim 8, in which the paraffin ingredient is a fully refined petroleum wax having a melting point ranging from about 130° F. to about 140° F.; in which the powdered starch consists of gelling pregelatinized starch; in which the dextrin ingredient consists of dextrin having a water solubility ranging from about 25% to about 55%; in which the microcrystalline wax has a melting point ranging from about 140° F. to about 160° F.; in which sodium chloride is present as an additional ingredient at a level of from about 0.5% to about 4% by weight; and in which lactic acid is used to adjust the pH to range from 5.0 to 7.0.

10. A bar as recited in claim 9, in which the coconut-oil fatty acid is present in an amount ranging from about 1.5% to about 2.5%.

11. A bar as recited in claim 1, in which the coconut-oil fatty acid is present in an amount ranging from about 1.5% to about 2.5%.

* * * * *